US008323078B2

(12) United States Patent
Marble

(10) Patent No.: US 8,323,078 B2
(45) Date of Patent: Dec. 4, 2012

(54) APPARATUS FOR POLISHING SEMI-CONDUCTOR DICE

(75) Inventor: Christopher Leigh Marble, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1089 days.

(21) Appl. No.: 12/115,140

(22) Filed: May 5, 2008

(65) Prior Publication Data

US 2009/0275271 A1 Nov. 5, 2009

(51) Int. Cl.
*B24B 41/06* (2012.01)

(52) U.S. Cl. ..... 451/405; 451/282; 451/384

(58) Field of Classification Search ..... 269/289 R, 269/302.1, 903; 451/41, 241, 267, 282, 384, 451/386, 387, 391, 405, 545, 549, 555
See application file for complete search history.

(56) References Cited

U.S. PATENT DOCUMENTS 4,876,826 A * 10/1989 Denboer ..... 451/278
5,272,844 A 12/1993 Burgess et al.
5,674,109 A 10/1997 Kanzawa et al.
7,115,020 B1 * 10/2006 Biskeborn ..... 451/11

OTHER PUBLICATIONS

International Search Report—PCT/US2009/042057, International Search Authority—European Patent Office—Aug. 27, 2009.
Written Opinion—PCT/US2009/042057, Internatonal Search Authority—European Patent Office Aug. 27, 2009.

* cited by examiner

*Primary Examiner* — Timothy V Eley
(74) *Attorney, Agent, or Firm* — Michael Gallardo; Nicholas J. Pauley; Jonathan T. Velasco

(57) ABSTRACT

Hands free removal of layers of material simultaneously from a number of dies is accomplished by temporarily positioning a plurality of die holding devices into different segmented open areas of a template mounted over the grinding surface. In one embodiment, frictional force imparted to each holding device by the grinding wheel serves to position the holding device against a stop within the confines of each opening. The stop in each segment could be positioned at a different radial distance from the center of the grinding wheel in order to use different portions of the grinding wheel to grind each of the dies. In some embodiments, the segments are offset from each other around the template in order to increase the effective working area of the grinding surface.

12 Claims, 5 Drawing Sheets

APPARATUS FOR POLISHING SEMI-CONDUCTOR DICE

TECHNICAL FIELD

This disclosure relates to polishing semiconductors and more particularly to apparatuses and methods for hands free removal of layers of material simultaneously from a number of semiconductor dice.

BACKGROUND

It is often necessary to grind (polish) off layers of a semiconductor so that the inner structures can be made available for visual inspection, often by observation using an electron microscope. A polishing fixture useful for holding the semiconductor (or other device to be polished) against a polishing wheel for this purpose is the subject of U.S. Pat. No. 5,272,844. Some polishing operations are now performed using a positioning structure that is suspended over a grinding wheel. The positioning structure is a frame with an open center and a plurality of circumferentially spaced openings into which a die holding tool can be placed. The operator uses the side of the opening to help stabilize the holding tool while the die is being polished. Problems exist with the positioning device when it is desired to polish dies without requiring the operator to keep his/her hands on the tool. These problems primarily concern the fact that the tool is not held securely and thus "wobbles". Stops are provided on the device for maintaining the tool within the openings. However, the stops are ineffective for their intended purpose.

Polishing in this manner is a manual process which can take anywhere from half a day to two or three days with an operator standing in front of the grinding wheel and holding the device while the wheel spins. The holding device is constructed such that it allows for the semiconductor to be positioned in various orientations depending upon the planar angle desired to be grinded away. This procedure is slow and tedious and often results in cramped hands and fingers.

BRIEF SUMMARY

Hands free removal of layers of material simultaneously from a number of dice is accomplished by temporarily positioning a plurality of die holding devices into different segmented open areas of a template mounted over the grinding surface. In one embodiment, frictional force imparted to each holding device by the grinding wheel serves to position the holding device against a stop within the confines of each opening. The stop in each segment could be positioned at a different radial distance from the center of the grinding wheel in order to use different portions of the grinding wheel to grind each of the dice. In some embodiments, the segments are offset from each other around the template in order to increase the effective working area of the grinding surface.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
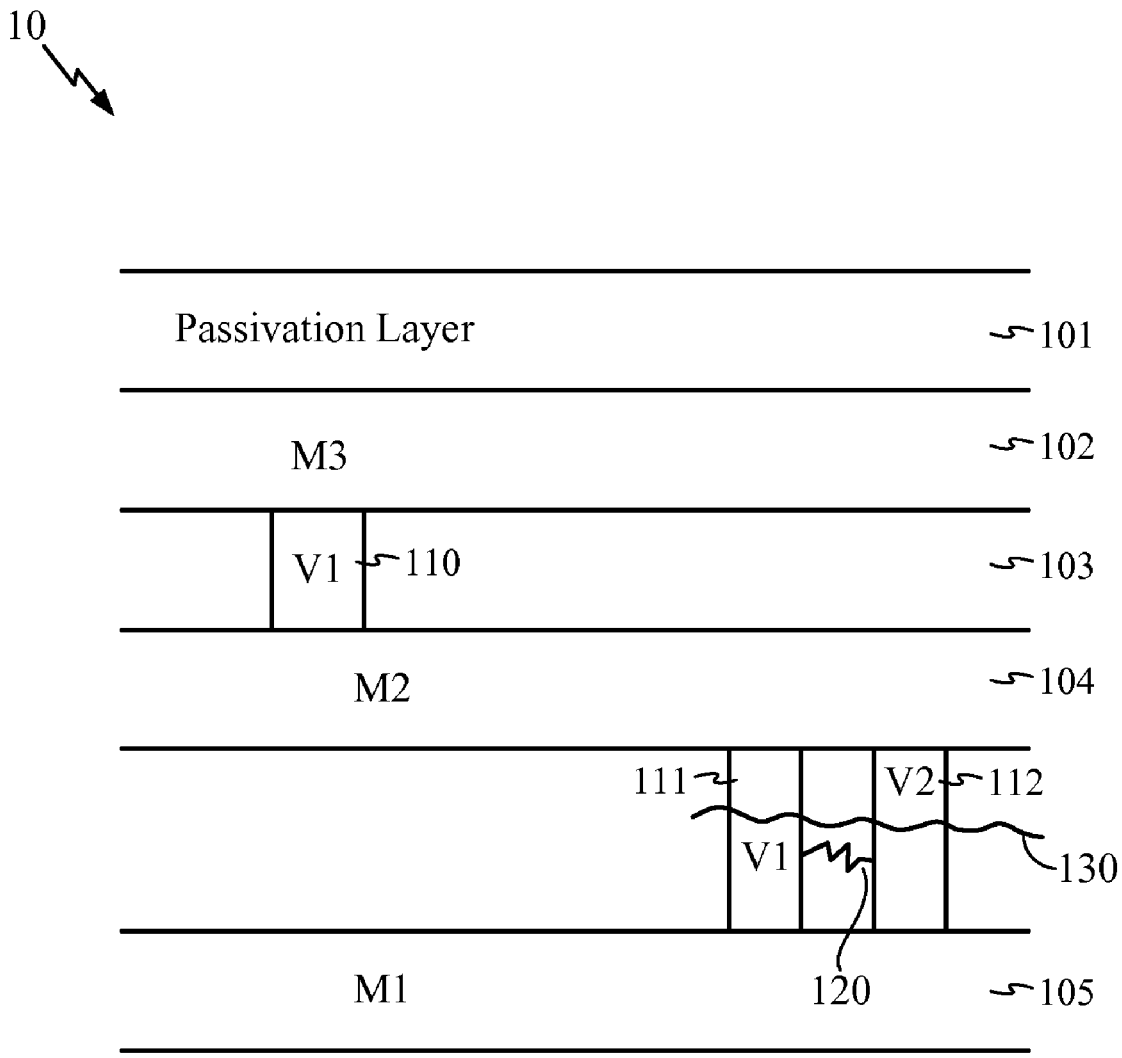
FIG. 1A illustrates a typical multi-layered semi-conductor.

FIG. 1A illustrates a typical multi-layered semi-conductor (die), such as semi-conductor die 10. As shown, die 10 has passivation layer 101, layers 102, 103, 104 and 105 in which active circuits can be constructed and vias 110, 111 and 112. Electrical connections can be constructed to pass from one layer to another through one or more of the vias.

Figure 1B:
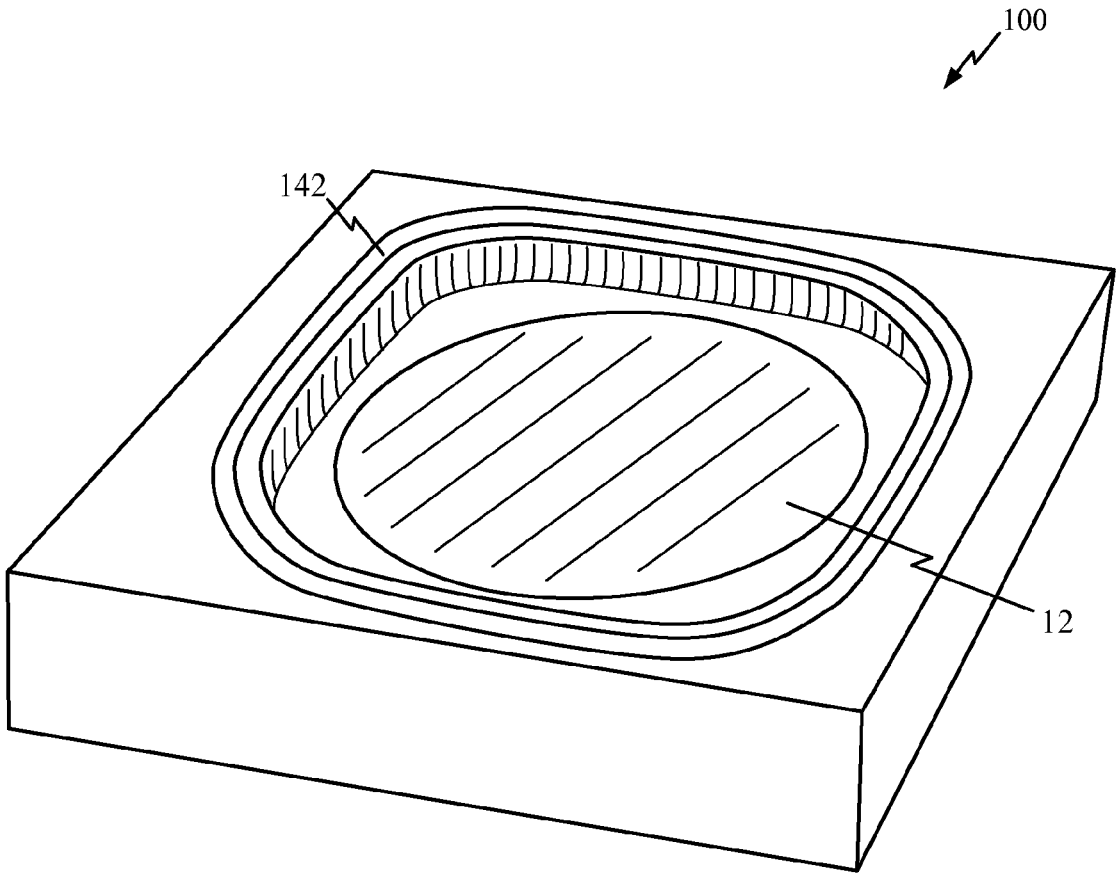
FIG. 1B shows a typical grinder used for polishing layers of a semi-conductor.

It could happen that during the design and/or manufacturing process a defect occurs within a die. Before that defect can be remedied for subsequently produced dice, the defect must be identified. For example, assume that a malfunction is detected in the circuit operation of a manufactured die, such as die 10. In such a situation, die 10 would be delayered by grinding off successive planes of material, using, for example, grinder 100 shown in FIG. 1B. A surface of die 10, such as surface 101, would be held in contact with moving grinding surface 12 of grinder 100 and over time surface 101 would be removed exposing layer 102 to view by, for example, electron magnification. If layer 102 is determined to be free of defects then via 110 is slowly polished away with the operator viewing, from time to time, via 110 for possible defects. As will be discussed, the IC package can be positioned within a tool (a T-tool) and the angle of attack of the IC package with respect to the plane of grinding surface 12 can be adjusted as desired. The tool that holds the die can be any of the well-known tools for holding dice for polishing, such are obtainable from TD Jam Precision. These tools have silicon feet that allow the tool to hold the work piece at various angles to the grinding surface. The work piece (die) can be fastened to the tool using fasteners, screws, epoxy, glue, springs or the like.

Sometimes the fault is pre-isolated to a certain layer or layers so that stopping the process before arriving at those layers is not necessary. Thus, if it is known (from electrical testing or otherwise) that a fault is contained in die 10 somewhere between layers 104 and 105 then layers 101 through 103 would be polished away without detailed observation. Timing may determine how deep (how many layers) the polishing has gone through.

In the example being discussed, the polishing continues, typically using a micron slurry (not shown), until the structure preceding level 130 has been removed (delayered). Polishing continues with observations being made after a particular amount has been renewed (for example, every ½ micron). Eventually, defect 120 will become visible and the operator will see that via 111 is shorted to via 112 by defect 120. Often it is required to polish several IC devices in this fashion to find one or more defects. This might take a half day or even a full day (and sometimes longer) for each IC device. This process is known in the industry as P (as in polishing)-lapping.

Figure 2:
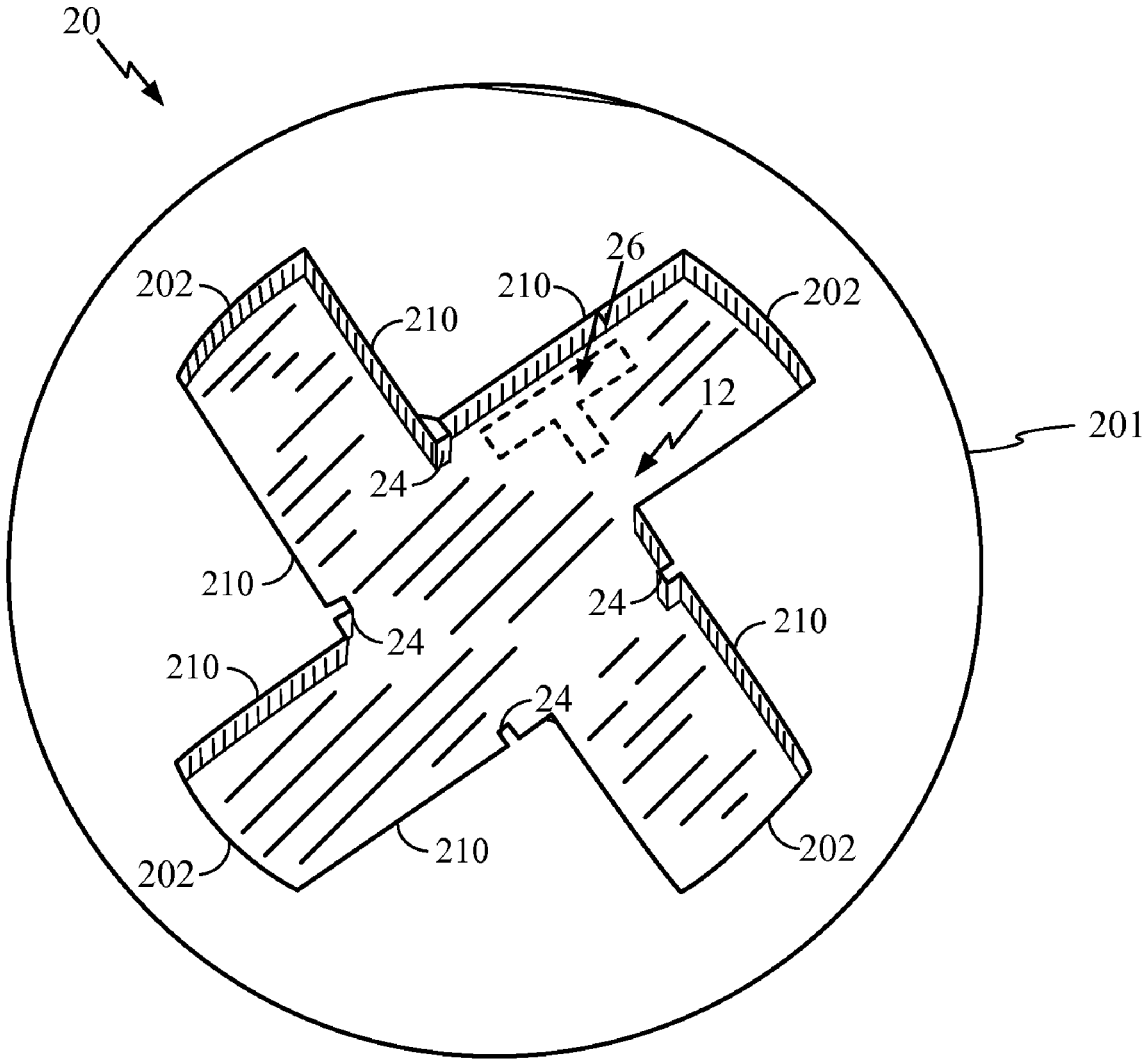
FIG. 2 shows a top view of one embodiment of a multi-segmented device for holding multiple die during polishing.

FIG. 2 shows a top view of one embodiment of a multi-segmented device, such as device 20, for holding multiple dice during parallel polishing of the die. Device 20 has an outer periphery 201 that is designed to mate with an outer periphery (142 FIG. 1) of grinder 100. If desired, inserts (not shown) can be used to fit device 20 to grinders, such as grinder 100 (FIG. 1A), if the grinder has physical dimensions different from the physical dimensions of device 20. The surface area of grinder 12 is seen looking down into the open area ("wings") 202 of device 20, which in the embodiment illustrated has pinwheel openings. In this embodiment, grinder surface 12 will be assumed to rotate or move counter-clockwise with respect to device 20 which is held stationary with the frame of grinder 20 (FIG. 1A).

Positioned within each slot 202 is at least one stop 24. The stops 24 for each of the slots 202 can be at the same radius (as measured from the center of the grinder 100 outward) or preferably at different radii so that wear on the grinding surface 12 will be spaced radially outward as will be discussed. For 7 mm dies the stops 24 can be spaced 7 mm offset from each other.

In operation, a device to be polished is positioned on the bottom surface (not shown in FIG. 2) of removable tool 26. Once the die is secured in tool 26, the tool 26 is then positioned within one of the slots 202 against grinding surface 12. This positioning can be accomplished without regard to whether grinder 100 is operating or stopped. Friction force of the moving grinder surface 12 with respect to the substrate will force the tool 26 holding the substrate (die) against the side wall and against stop 24.

Tool 26 will continue to rest against stop 24 while grinder surface 12 rotates there under without requiring the operator to maintain pressure or even touch the tool 26. Using this arrangement, several tools 26 (in this embodiment three other tools) can be positioned in the other slots 202 of device 20 so that four dice can be simultaneously polished using the same grinder 100, all without necessitating the use of the operator's hands to maintain the position of the respective tools 26. Note that the die holding tools 26 need not be the same, since each slot 202 operates independently from each other slot 202. Also note that while only one tool 26 is discussed as being positionable within a slot 202, device 20 could be designed such that multiple tools 26 could be self-positioned within each slot 202 if the diameter of the grinding surface 12 is large enough to support multiple tools 26.

By staggering the placement of each tool 26, in one example, by 7 mm, the grinding surface 12 can be worn evenly and the slurry can also be positioned evenly because centripetal force will move the slurry from the center outward.

Stops 24 can be designed for a mating relationship with the end of the T tool 26, so as to prevent wobble of the tool 26 and to maintain the tool 26 within the confines of the slot 202 in which the tool 26 is placed. In one embodiment, the stops 24 are rounded to fit the ends of the T tool 26. In other embodiments, the stops 24 are at 90 degree angles with respect to the downstream side wall of the slot 202. The height of the slot sides can be made to fit the tool height. In one embodiment this height is 15 mm. Also note that the slots 202 are not symmetrical about the center, and are offset from symmetrical by approximately 17.5 mm., such that the central openings of each slot 202 are not exactly opposite each other. This offset is so that a grinder surface 12 having a fixed diameter can handle more dice than it could be if the slots 202 were perfectly symmetrical about the center of the grinder 100. The actual interior contour of each slot 202 is not critical but should be designed such that the T tool, or other dice holding device 26, is easily positioned within the slot area 202, both for placement and removal.

A cover, or partial cover, can be positioned above each slot 202 if desired. The cover, or partial cover can act as a splash guard to keep the slurry confined within the cover or dome.

Note that tool 26 could be designed with a number of indents along the top of T portion. The indents could mate with one or more tabs protruding from wall 210 thereby holding the tool 26 in a fixed relationship within each slot 202.

Figure 3:
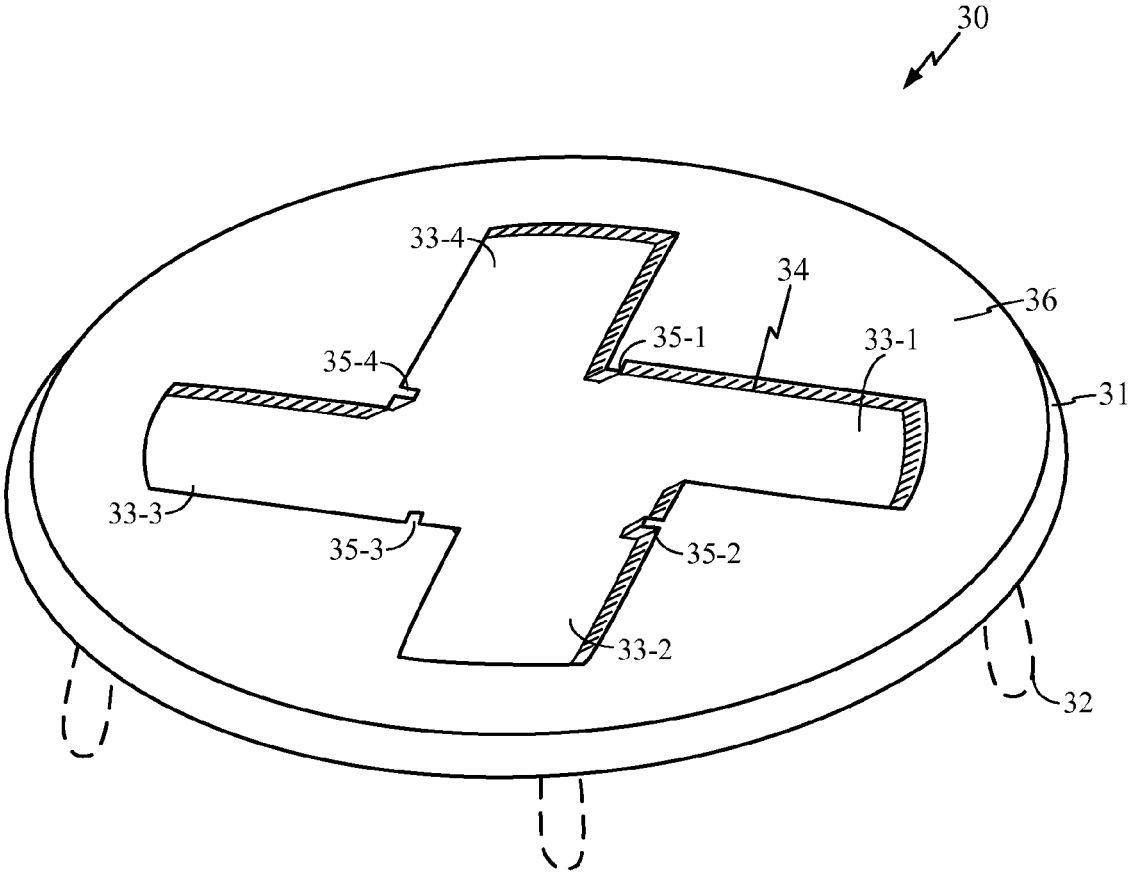
FIG. 3 is a perspective view of one embodiment of a support structure.

FIG. 3 is a perspective view of one embodiment 30 of a template structure utilizing the concepts of this disclosure. In the embodiment shown, support (polishing template) 30 has outer periphery 31 designed to attach permanently or temporarily to a grinder 100. This attachment can be, for example, by a skirt (not shown) around the periphery of the support where the skirt mates with the grinder 100. The grinder attachment could also be feet, such as feet 32 which attach to the grinder 100 to prevent template 30 from moving while the grinder 100 is moving. The peripheral support could also mate with the fixed structure of the grinder 100 by using, for example, fasteners friction, notches, Velcro or the like. Top surface 36 can be thought of as a bridge suspended from periphery 31 (and supports 32) over the grinding surface. In the embodiment shown, surface 36 is relatively flat, but surface 36 can have portions curved upward over slots 33-1 to 33-4 to form a partial cover or dome over the slots to help prevent splashing of slurry from the grinder surface 12 when the template is being used. The template is open in the center to allow the die and its holding tool 26 to be placed on the grinding surface 12 as discussed above with respect to FIG. 2.

The template extends over the grinding surface 12 and has one or more slots 33-1 to 33-4 radiating outward from the center opening toward the peripheral support. Each slot area 33-1 to 33-4 would have at least one side wall 34 extending downward from the center to a point just above the grinding surface 12. The exact distance above the grinding surface 12 where the bottom of the template wall 34 is positioned is controlled by the height of the skirt (or legs) 32 around the periphery 31 and is not critical so long as the side wall 34 has enough surface area, height 'h', to impart stability to the T tool 26. The side wall 34 is constructed on what would be the down steam side of the slot area 33-1 to 33-4. Down stream in this context is the side of the slot area 33-1 to 33-4 toward which the grinding surface 12 moves. If the grinding surface 12 goes in both directions, then two sidewalls 34 will be required for self-supporting polishing operation to be employed in both directions. In the embodiment of FIG. 2, since the grinding surface 12 is assumed to be counter-clockwise then the downstream side of the slot area 33-1 to 33-4 is as shown on the left side of the slot area 33-1 to 33-4.

As discussed above, and in reference to FIG. 3, friction caused by the grinder 100 against the die surface under the T tool 26 forces a side (the top of the T tool) of the T tool 26 against the downstream side wall 34 and in mating relationship with the stop 35-1 to 35-4, such as with stops 35-1 to 35-4, mounted on the respective side walls 34. Since the stops 35-1 to 35-4 are positioned closer to the center of the grinding surface 12 than is the T tool 26, the movement of the grinder 100 pulls the T tool 26 against the stop 35-1 to 35-4. Because the stop 35-1 to 35-4 is designed to mate with, or at least have complementary structures with, the side of the T tool 26, the force of the friction from the grinding surface 12 on the die causes the T tool 26 to be held in a stable relationship with respect to the downstream side wall 34 and the stop 35-1 to 35-4.

Once the holding tool 26 is placed in the slot 33-1 to 33-4, friction holds the tool 26 in place. The operator is then free to place other dice in other slot areas 33-1 to 33-4. At any time during the polishing process any tool 26can be easily removed while the grinder 100 continues to polish the other dice. Thus, the operator can remove or replace any die at any time without disturbing the other dice which remain positioned relative to their respective downstream side walls 34.

Figure 4:
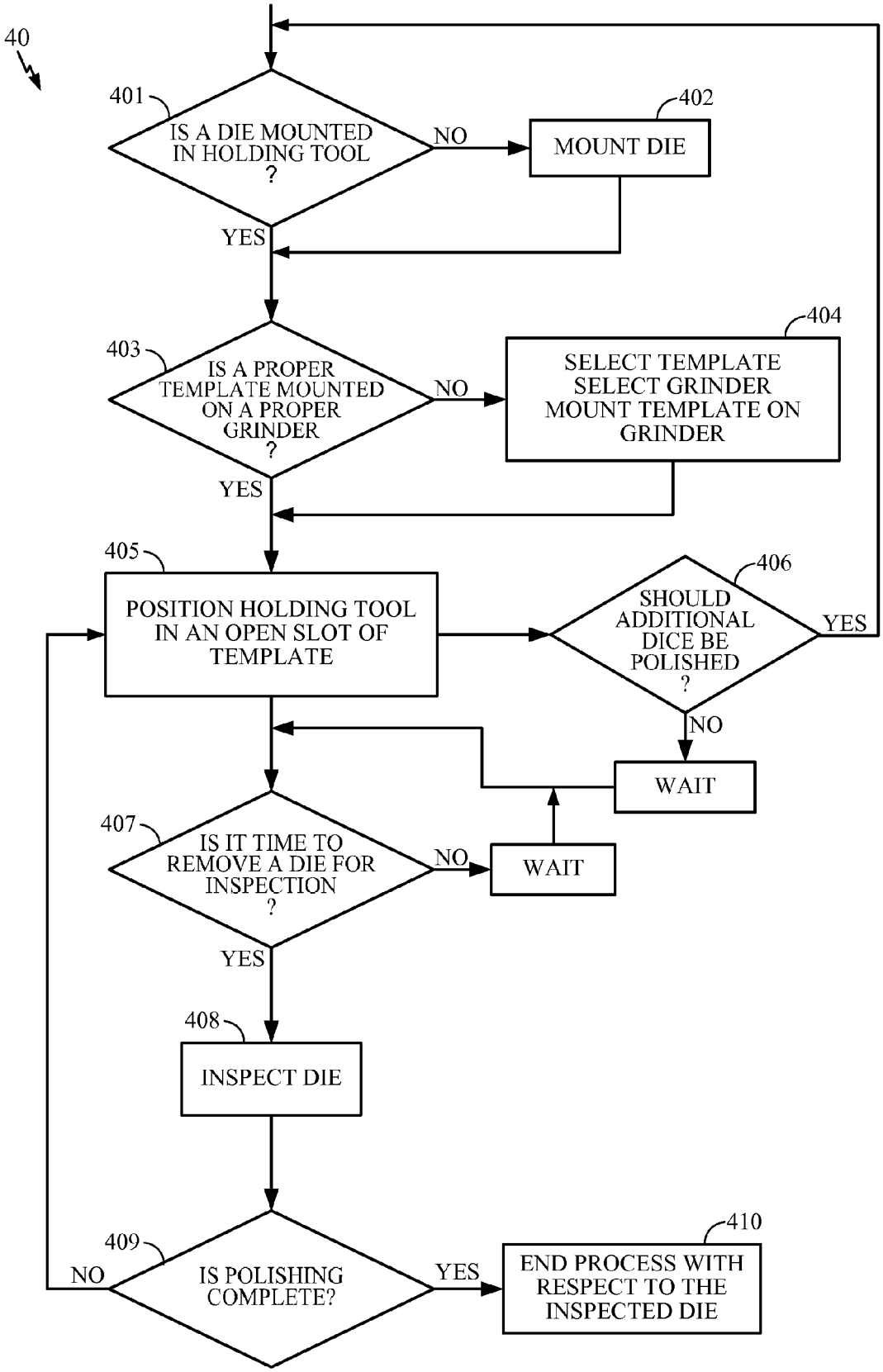
FIG. 4 shows one embodiment of a flow chart of one method for using the polishing support concepts discussed herein.

FIG. 4 shows one embodiment 40 of a flow chart of one method for using the polishing support concepts discussed herein. Process 401 determines if there is a die mounted in a holding tool ready to be polished. If not, then process 402 allows an operator or a machine to mount the die by selecting the desired orientation of the die to be presented to the grinding (polishing) surface.

Process 403 determines if a proper template is positioned on the proper grinder and if not process 404 selects the proper template and grinder and secures the template to the grinder.

Process 405 then positions the held die in an open slot of the selected template. The grinder is turned on (if it is not already on) and the bottom surface of the positioned die is polished for a period of time. The polishing results from the fact that the grinding surface moves relative to the die surface such that friction caused by the grinding surface against the die causes a side of the holding tool to move against the downstream side wall and in mating relationship with the stop mounted on the side wall.

After process 405 is complete, process 406 determines if additional dies are available for polishing. If so, processes 401 through 406 are reiterated and second, third and fourth tools can be positioned concurrently in other slots of the selected template.

Process 407 determines if it is time to inspect one of the positioned dice. This can be by elapsed time, or in some situations by other signals available to the operator. When it is time for inspection, process 408 removes the die from the slot while the grinding surface continues to move relative to the template support and the die is inspected.

Process 409 determines if polishing is complete with respect to the inspected die. If it is, the die is not returned to the template. If polishing is not complete then process 405 is reentered. If polishing is complete then process 410 ends the polishing with respect to the inspected die. Note that even though one die has been removed from the template the other dies continue to be polished in a hands-free manner.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus for facilitating polishing of at least one die, said apparatus comprising:

a template for positioning over a polishing surface, said template comprising a first slot extending radially outward from a center of said template, said first slot allowing a die to be positioned therein for parallel polishing with respect to said polishing surface;

said first slot having at least one side wall extending downwardly within said template toward said polishing surface, wherein when said template is positioned over said polishing surface, said wall extends a height above said polishing surface, and said height being at least equal to a height of a tool used to hold said die;

a first stop located within a portion of said first slot that is closest to a center of said template, said first stop being operative for maintaining a die positioned within said first slot stationary and in contact with said polishing surface when said polishing surface moves relative to said positioned die;

a second slot extending radially outward from said center of said template, the second slot offset from said first slot; and a second stop located within a portion of said second slot that is closest to the center of said template, said first and second stops being positioned at different distances from the center relative to each other.

2. The apparatus of claim 1 wherein said second slot comprises:

at least one side wall extending downwardly within said template toward said polishing surface when said template is positioned over said polishing surface, said at least one side wall of said second slot extending a height 'h' above said polishing surface, said height 'h' being at least equal to a height of a tool used to hold said die, and said second stop being operative for maintaining a die positioned within said second slot stationary and in contact with said polishing surface while said polishing surface moves relative to said positioned die within the second slot.

3. The apparatus of claim 1 wherein a central opening of said second slot is not exactly opposite a central opening of the first slot.

4. The apparatus of claim 3 wherein said apparatus further comprises:

a splash guard formed over said first and second slots, said splash guard having an opening at said center of said template.

5. A die polishing tool support comprising:

a peripheral portion for temporary mating with a grinder;

a template supported by said peripheral portion, said template being held by said peripheral portion above a grinding surface of said grinder to which said peripheral portion is mated, said template having an open central portion;

a first slot formed in said template, said first slot extending radially outward from said open central portion toward said peripheral portion;

a second slot formed in said template, said second slot extending radially outward from said open central portion toward said peripheral portion and laterally displaced from said first slot, said first and second slots each having a side wall portion extending downward within said template to a position just above said grinding surface, said side wall of said first and second slots having a height above said grinder surface sufficient for restraining movement of a first die mounting tool placed within said first slot or a second die mounting tool placed within said second slot;

a first stop being positioned on said side wall of said first slot at a portion closest to a center point of said template, said first stop comprising a structure for facilitating said restraining of said first die mounting tool, said restraining facilitated in part by movement of said grinding surface with respect to a substrate of a first die on said first die mounting tool placed within said first slot; and a second stop positioned on said side wall of said second slot at a portion closest to said center point of said template, said second stop comprising a structure for facilitating restraining of said second die mounting tool in part by movement of said grinding surface with respect to a substrate of a second die on said second die mounting tool placed within said second slot;

in which said first and second stops are positioned within respective ones of said first and second slots at different radii.

6. The tool of claim 5 wherein a radius of said second stop from said center point of said template is greater than a radius of said first stop from said center point of said template by a width of a die being polished.

7. The tool of claim 6 wherein said width is at least 7 MM.

8. The tool of claim 5 wherein said height of said side walls are at least 15 mm.

9. The tool of claim 5 wherein said slots are positioned around the center point of said template such that central openings of said slots are not exactly opposite each other.

10. An apparatus for facilitating polishing of at least one die, said apparatus comprising:

means for positioning at least one die over a polishing surface, said positioning means comprising first means for supporting a tool, the first toot supporting means extending radially outward from a center of said positioning means, said first tool supporting means allowing said at least one die to be positioned therein for parallel polishing with respect to said polishing surface, said first tool supporting means having at least one side wall extending downwardly within said positioning means toward said polishing surface, wherein when said positioning means is positioned over said polishing surface, said wall extends a height above said polishing surface, and said height being at least equal to a height of a tool used to hold said at least one die;

first means for maintaining the at least one die stationary and in contact with said polishing surface when said polishing surface moves relative to said positioned at least one die, the first means for maintaining positioned within said first tool supporting means, said first means for maintaining being located in a portion of the first tool supporting means that is closest to said center of the positioning means;

a second tool supporting means extending radially outward from said center of said positioning means, the second tool supporting means offset from said first tool supporting means; and second means for maintaining the at least one die stationary and in contact with the polishing surface, the second maintaining means being located within a contour of said second tool supporting means, said second means for maintaining being located in a portion of the second tool supporting means that is closest to said center of said positioning means, said at least one first and second maintaining means being positioned at different distances from the center relative to each other.

11. The apparatus of claim 10 wherein central openings of each supporting means are not exactly opposite each other.

12. A die polishing tool support comprising:

a peripheral portion for temporary mating with a grinder;

means for positioning at least one die over a polishing surface, the positioning means supported by the peripheral portion, the positioning means being held by the peripheral portion above a grinding surface of the grinder to which the peripheral portion is mated, the positioning means having an open central portion;

first tool supporting means formed in the positioning means, the first tool supporting means extending radially outward from the open central portion toward the peripheral portion;

second tool supporting means formed in the positioning means, the second tool supporting means extending radially outward from the open central portion toward the peripheral portion and laterally displaced from the first tool supporting means, the first and second tool supporting means each having a side wall portion extending downwardly within the positioning means to a position just above the grinding surface, the side wall of the first and second tool supporting means having a height above the grinder surface sufficient for restraining movement of a first die mounting tool placed within the first tool supporting means or a second die mounting tool placed within the second tool supporting means;

first means for maintaining at least one die stationary, the first maintaining means being positioned on the side wall of the first tool supporting means at a portion of the first tool supporting means that is closest to the open central portion of the positioning means, the first maintaining means comprising a structure for facilitating restraining of the first die mounting tool, the restraining facilitated in part by movement of the grinding surface with respect to a substrate of the at least one die on the first die mounting tool placed within the first tool supporting means; and second means for maintaining the at least one die stationary, the second maintaining means being positioned on the side wall of the second tool supporting means at a portion of the second tool supporting means that is closest to the open central portion of the positioning means, the second maintaining means comprising a structure for facilitating restraining of a second tool in part by movement of the grinding surface with respect to a substrate of the at least one die on the second die mounting tool placed within the second tool supporting means;

in which the first and second maintaining means are positioned within respective ones of the first and second tool supporting means at different radii.

* * * * *